US005406879A

United States Patent [19]

Willacy

[11] Patent Number: 5,406,879

[45] Date of Patent: Apr. 18, 1995

[54] ACTUATOR LOCK

[75] Inventor: Steven J. Willacy, Ilkley, United Kingdom

[73] Assignee: Lucas Industries, England

[21] Appl. No.: 163,127

[22] Filed: Dec. 7, 1993

[30] Foreign Application Priority Data

Dec. 9, 1992 [GB] United Kingdom ..... 9225752

[51] Int. Cl.[6] ..... F15B 15/26

[52] U.S. Cl. ..... 92/24; 92/27; 92/28

[58] Field of Search ..... 92/23, 24, 27, 28, 26, 92/29, 15, 17, 18, 20, 21 R, 22; 91/41, 44

[56] References Cited

U.S. PATENT DOCUMENTS

| | | | |
|---|---|---|---|
| 3,033,171 | 5/1962 | Engelbrechet et al. . | |
| 3,320,861 | 5/1967 | Johnson et al. | 92/29 |
| 3,353,454 | 11/1967 | Donovan | 92/29 |
| 3,356,186 | 12/1967 | Lambers | 92/15 |
| 3,470,793 | 10/1969 | Hanchen | 92/20 |
| 4,257,315 | 3/1981 | Tisell et al. | 92/26 |
| 4,471,944 | 9/1984 | Leray et al. | 92/29 |
| 4,524,676 | 6/1985 | Rogers . | |
| 4,795,110 | 1/1989 | Lang . | |
| 5,056,418 | 10/1991 | Granger et al. | 92/15 |
| 5,095,083 | 3/1992 | Baldridge | 92/27 |

FOREIGN PATENT DOCUMENTS

| | | | |
|---|---|---|---|
| 2219824 | 10/1973 | Germany | 92/28 |
| 3913009 | 10/1990 | Germany . | |
| 4120455 | 12/1992 | Germany | 92/24 |
| 1496793 | 1/1978 | United Kingdom . | |

*Primary Examiner*—Thomas E. Denion
*Attorney, Agent, or Firm*—Andrus, Sceales, Starke & Sawall

[57] ABSTRACT

An actuator lock is provided to prevent movement of an actuator until the actuator lock is released. A first member of the lock is movable in response to fluid pressure within a chamber to move from a locked position to an unlocked position allowing the actuator to move. The first member is held at the unlock position by a latching member so that the lock cannot return to the locked position. During testing of the actuator, a test member is operable to reversibly move the first member from the locked position to an unlocked and unlatched position.

14 Claims, 2 Drawing Sheets

ACTUATOR LOCK

The present invention relates to an actuator lock, for instance for locking an actuator for a control surface in a fixed position until operation of the actuator is required.

It is known to lock an actuator for a control surface in a fixed position until the movement of the control surface is required. The lock is then required to be disengaged and be held disengaged by a latch mechanism. However, such an arrangement is disadvantageous during maintenance and testing of the actuator and its control system because, in order to test the actuator, the lock must be deployed to the unlocked position, where it latches. The lock may then have to be disassembled in order to return the lock to the locked state.

U.S. Pat. No. 4,795,110 describes a lock for an actuator of a flight control surface in which a pivotally mounted arm is actuated by a solenoid to disengage from a detent formed in an actuator element. The arm is biased into engagement with the detent by a spring. The solenoid is energised to disengage the arm from the detent. The arm is latched out of engagement with the detent by the solenoid and returns to the locking position only when the solenoid is de-energised.

It is also known to release a spring loaded lock member from a detent by the application of pressure fluid and to latch it at the extreme of its unlocking movement against the spring. Unlocking without latching may be carried out by application of pressure fluid at a pressure insufficient to cause the member to compress the spring sufficiently for the member to reach its latching position.

This solution requires the ability to accurately control the pressure of the actuating fluid.

There is a requirement, not satisfied by prior art arrangements, for a simple mechanical locking arrangement which latches when released in normal operation and yet may be released without latching for test purposes and which does not rely on accurate control of fluid pressure (for example, pneumatic pressure) or on an electrical supply.

According to a first aspect of the present invention, there is provided an actuator lock, comprising a first member movable between first and second positions, a latching member arranged to latch the first member at the second position when the first member reaches the second position, biasing means for biasing the first member towards the first position, and a test member movable between third and fourth positions for moving the first member from the first position to a test position at which the first member is unlatched.

It is thus possible to provide an actuator lock in which a locking element thereof can be moved between a locked position for preventing movement of the actuator, an unlocked and latched position for allowing movement of the actuator and preventing the locking element from returning to the locked position, and an unlocked and unlatched position for allowing testing of the actuator.

Preferably, at the first position, the first member extends from the lock and engages a detent in a shaft of an actuator.

Preferably the lock has a housing acting as a cylinder having a first end wall and the first member has an enlarged section and is slidable within the cylinder. Advantageously the enlarged section may form a piston within the cylinder. A spring may be provided to urge the first member towards the first end wall of the cylinder. The first member may have a shaft section extending in substantially fluid sealed engagement through an aperture in the first end wall.

Preferably the test member is an annular member slidable within, and in substantially fluid sealed engagement with, the housing. Advantageously the test member and the first member are co-axial. The shaft section of the first member may extend through the centre of the test member. Advantageously the test member is in substantially fluid sealed engagement with the shaft section. The test member may be disposed between the first end wall and the enlarged section of the first member.

Advantageously a variable volume chamber may be defined by the first end wall, the housing and the first member and/or the test member.

Preferably a passage is formed through the housing to provide fluid flow communication with the variable volume chamber.

The enlarged section of the first member and the test member may cooperate to form concentric pistons. The enlarged section of the first member may have a shoulder formed thereon to support the test member. Advantageously an arrester is provided within the housing to abut against the test member when the test member has moved to the fourth position. Thus, the piston section of the first member and the test member may cooperate to form a first piston having a first area for moving the first member from the first position to the test position. Whereas the piston section of the first member alone is responsible for moving the first member from the test position to the second position.

In an alternative arrangement the effective area of the piston section of the first member may be reduced to zero. Thus it is the amount of kinetic energy imparted into the first member during movement from the first position to the test position which determines whether or not the first member can move against the urging of the biasing means from the test position to the second position. Thus to move from the first position to the test position the pressure within the variable volume chamber is increased less rapidly than compared to the rate of increase required to move the first member from the first position to the second position.

The latching member may be held in the wall of the housing and may cooperate with the shoulder of the first member so as to lock the first member against movement from the second position to the first position. Alternatively a groove or recess may be formed in the first member for cooperating with the latching member.

In an alternative arrangement, the test member may permit operation of the latching member when the test member is at the third position and inhibit operation of the latching member when the test member is at the fourth position.

Alternatively one of the shaft section and the test member may carry the latching member. The latching member may be biased towards the other one of the shaft section and the test member. Preferably the other one of the shaft section and the test member has a recess arranged to receive and permanently engage the latching member only when the first member is at the second position and the test member is at the third position. The latching member may be a circlip held in a compressed state. In an expanded state, the circlip prevents the first member from moving from the second position to the first position.

Preferably a further variable volume chamber is formed between the test member and the enlarged section of the first member. Preferably at least one of the test member and the enlarged section has a recess therein forming part of the further variable volume chamber. Preferably a further passage is formed through the cylinder wall to communicate with the further variable volume chamber.

Pressure within the further variable volume chamber may be increased to urge the first member to the second position and the test member to the third position, thereby latching the first member at the second position.

Pressure within the variable volume chamber may be increased to urge the first and test members to the second and fourth positions, respectively, thereby inhibiting the latch and allowing the biasing means to return the first member to the first position when the pressure in the chamber is reduced.

According to a second aspect of the present invention there is provided an actuator lock, comprising a first member movable between first and second positions, a latching member arranged to latch the first member at the second position when the first member reaches the second position, biasing means for biasing the first member towards the first position, and a test member movable between a third position for permitting operation of the latching member and a fourth position at which operation of the latching member is inhibited.

The present invention will further be described, by way of example, with reference to the accompanying drawings, in which.

Figure 1:
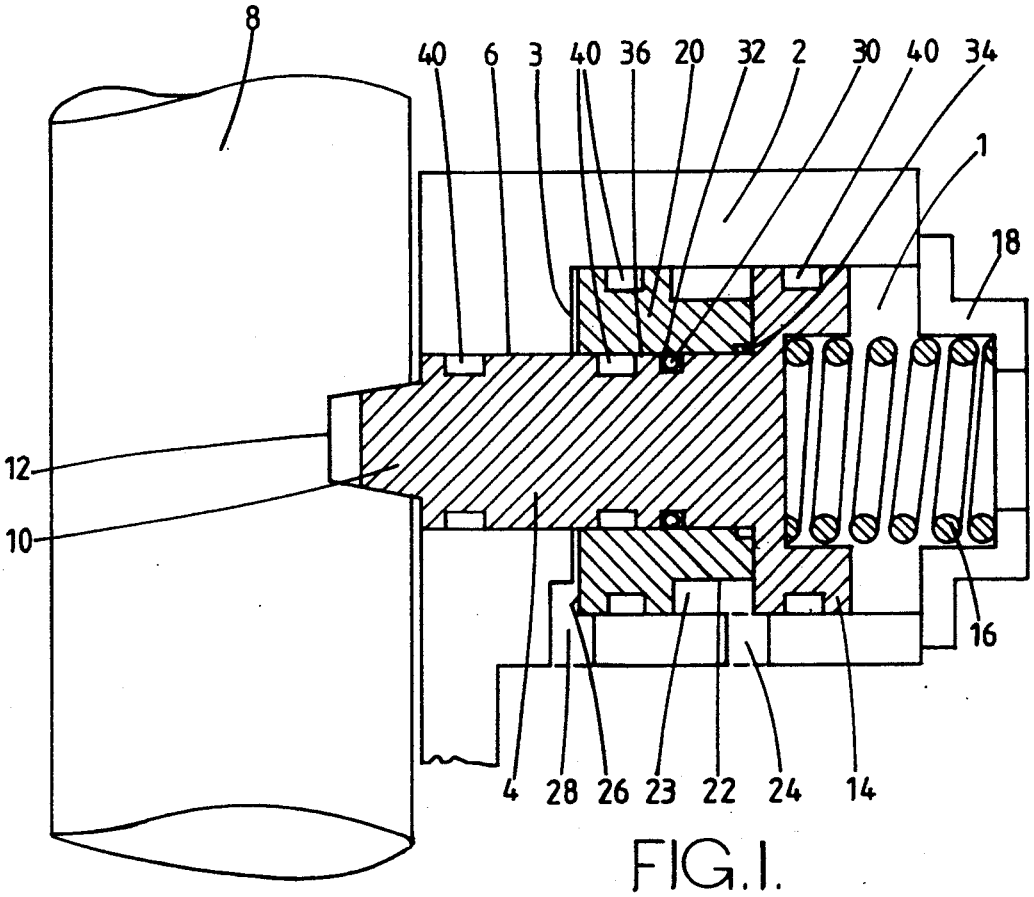
FIG. 1 is a cross-sectional view of a lock constituting a first embodiment of the present invention.

The lock shown in FIG. 1 comprises a cylinder 1 within a housing 2. A first member 4 extends through a first end 3 of the cylinder 1 towards an actuator shaft 8 via a passage 6 in the housing 2. An engagement piece 10 is formed at a first end of the first member 4. The piece 10 is arranged to engage a recess 12 formed in the shaft 8 so as to lock the shaft 8, for example against rotation, at a predetermined position.

A second end of the first member 4 has an enlarged portion 14 which acts as a piston within the cylinder 1. A compression spring 16, held by a holder 18 at a second end of the cylinder 1 and in a recess in the enlarged portion 14, urges the first member towards, and into locking engagement with, the shaft 8.

An annular test member 20 is disposed between the first end 3 of the cylinder 1 and the enlarged portion 14 of the first member 4. The first member 4 passes through the hole in, and is in substantially fluid sealed engagement with, the annular test member 20.

A first variable volume chamber 26 is formed between the first end 3 of the cylinder 1 and the test member 20. A supply passage 28 is formed in the housing 2 and allows fluid communication with the chamber 26 from a test source (not shown).

An annular recess 22 is formed in the test member 20 at a second end thereof. The recess 22 forms part of a second variable volume chamber 23 bounded by the enlarged portion 14, the housing 2 and the test member 20. A further supply passage 24 is formed in the housing 2 and allows fluid communication with the chamber 23 from an external source (not shown).

The first member carries a circlip 30 within a groove 32. The test member has a region 34 of increased diameter on its otherwise cylindrical inner surface 36. The circlip 30 is held in a compressed state by the surface 36.

Seals 40 are provided to prevent the escape of fluid from the lock and flow between the first and second chambers.

The seals 40 are held in recesses in the first and test members 4 and 20 positioned relative to the supply passages 24 and 28 such that movement of the first and test members 4 and 20 between the first and second, and third and fourth positions, respectively, does not result in the seals 40 being damaged by virtue of being moved across a supply passage.

The lock is shown in the locked position in FIG. 1. In a normal deployment, in which latching is required, the second variable volume chamber 23 is connected to a source of high pressure fluid via the further supply passage 24. The pressure urges the first member to move against the urging of the spring 16, thus disengaging the engagement piece 10 from the recess 12. The pressure also urges the test member 20 to move towards the first end 3. The relative movement between the first and test members brings the circlip 30 adjacent the region 34. The circlip expands into the region 34 and latches the first member in the deployed state. The pressure in the second chamber 23 may be reduced without causing movement of the first member 4 towards the shaft 8.

In order to reversibly deploy the lock, so that the engagement piece 10 can be returned to the recess 12, the first variable volume chamber 26 is connected to the test source of high pressure fluid via the supply passage 28. The pressure urges the test member to move away from the first end 3. The test member abuts the enlarged portion 14 of the first member 4 and causes the first member 4 to move against the urging of the spring 16. No relative movement occurs between the first and test members. Thus the circlip is unable to expand into the region 34. When the pressure in the first variable volume chamber 26 is reduced, the spring 16 urges both the first and test members to move towards the shaft 8.

Figure 2:
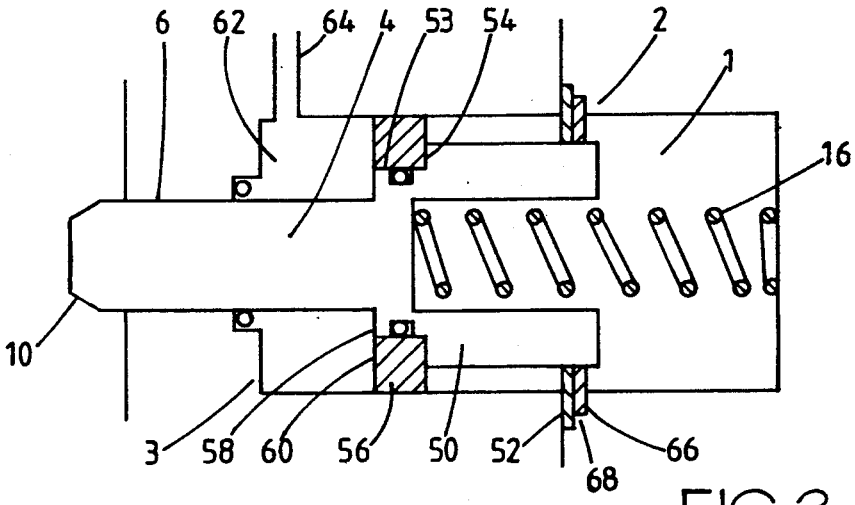
FIGS. 2 to 4 are cross-sectional views of a lock constituting a second embodiment of the invention at the locked, test and unlocked positions, respectively.
Figure 3:
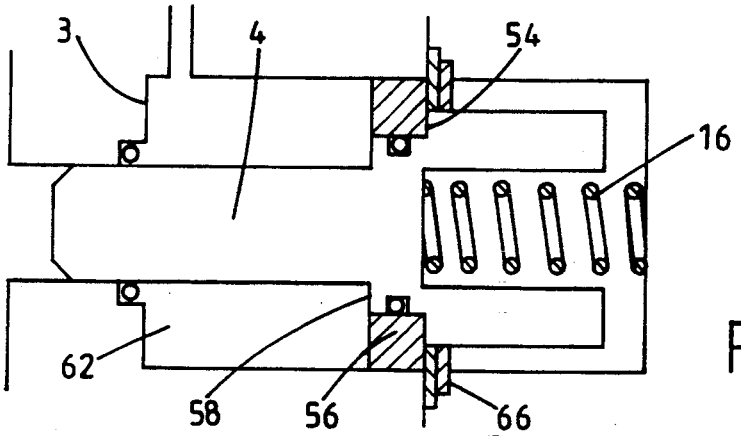
Figure 4:
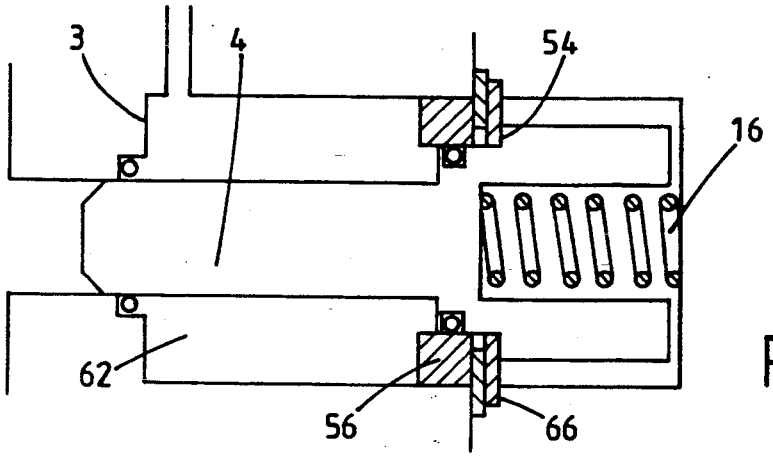

The lock illustrated in FIGS. 2 to 4 comprises a first member 4 movable within a cylinder 1 within a housing 2. As with the first embodiment, the first member 4 extends through a passage 6, has an engagement piece 10, and is biased towards a locked position by a compression spring 16.

The first member 4 has an enlarged portion 50 whose diameter is less than the diameter of the cylinder 1. A washer 52 extends from the wall of the cylinder 1 towards the enlarged portion 50. The washer 52 and the passage 6 hold the first member 4 co-axial with the cylinder 1. The enlarged portion 50 has an annular portion removed therefrom to reveal a cylindrical face 53 and a shoulder 54. An annular test member 56 is slidable in substantially fluid sealed engagement within the cylinder 1. The test member 56 is also in substantially fluid sealed sliding engagement with the face 53 of the first member 4. A surface 58 of the enlarged portion 50 faces towards a first end 3 of the cylinder 1. Similarly the test member has a face 60 facing towards the first end 3 of the cylinder 1. A variable volume chamber 62, into which fluid pressure can be applied via a passage 64 in the housing 2, is defined by the walls of the cylinder 1, the end face 3, the surface 58 and the test member 56.

An inwardly biased retaining spring 66 is held within a recess 68 in the wall of the cylinder 1 so as to extend from the housing 2 into the cylinder 1. The spring 66 bears against the enlarged portion 50 when the first member 4 is away from the second position.

The lock in FIG. 2 is at the first or locked position, ie the engagement piece 10 extends from the passage 6 to engage an actuator element (not shown) to lock the actuator element against movement. The pressure within the chamber 62 is relatively low.

In order to move the lock to a test position, as shown in FIG. 3, the pressure within the chamber 62 is increased, for example by supplying pressurized gas to the chamber 62. The pressure within the chamber 62 acts against the surface 58, which has an area $A_1$, and the surface 60, which has an area $A_2$. The test member 56 abuts the shoulder 54, so that, during movement between the first and test positions, the surfaces 58 and 60 cooperate to form a piston surface having an area equal to the sum of $A_1$ and $A_2$.

When the first member 4 reaches the test position, the test member abuts the washer 52, thereby preventing further axial movement of the test member 56 away from the end wall 3.

In order to latch the lock at the open or second position, as illustrated in FIG. 4, the pressure in the chamber 62 must be further increased. However, movement of the first member 4 from the test position towards the second position causes the test member 56 to lift away from the shoulder 54, thereby reducing the effective area of the piston surface to $A_1$. Thus significantly more pressure is required to move the first member against the urging of the spring 16 from the test position to the second or locking position than is required to move the first member 4 from the first position to the test position.

At the second position, the shoulder 54 moves past the retaining spring 66. The retaining spring 66 expands inwardly from the cylinder wall thereby forming an obstruction against which the shoulder 54 can abut. Thus, if the pressure in the chamber 62 is reduced such that the first member 4 is urged by the spring 16 to return to the first position, the shoulder 54 is brought into abutment with the retaining spring, thereby preventing the first member 4 from returning to the first position.

Figure 5:
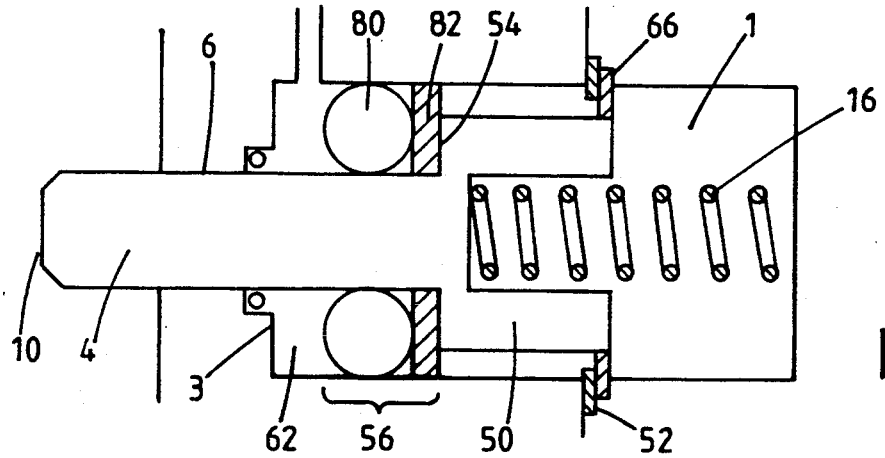
FIG. 5 is a cross-sectional view of a lock constituting a further embodiment of the present invention.

FIG. 5 shows a further embodiment of an actuator lock. The lock is a variation of that illustrated in FIGS. 2 to 4, and like parts are designated by like reference numbers. The area of the first surface 58 is reduced to zero whereas the area of the test member 56 has been correspondingly increased. The test member 56 is embodied as an O-ring 80 which forms a substantially fluid tight seal between the wall of the cylinder 1 and the first member 4. A back-up washer 82 is provided adjacent the O-ring 80 to provide further sealing. In use, the O-ring 80 abuts the back-up washer 82, which in turn abuts the shoulder 54 of the enlarged portion 50 of the first member 4.

To move the first member 4 from the first position to the test position, the pressure in the chamber is increased at a relatively slow rate. The O-ring 80 acts as a piston and pushes the first member 4 away from the first position against the urging of the spring 16 until the back-up washer 82 abuts the washer 52 extending from the wall of the cylinder 1. Movement of the first member ceases once the back-up washer abuts the washer 82. The first member 4 can return to the first position under the urging of the spring 16 when the pressure in the chamber 62 is reduced.

In order to move the first member 4 from the first position to the second position, at which it is latched, the pressure in the chamber 62 is increased rapidly so as to cause the first member to move with great speed and thereby store sufficient kinetic energy to allow the first member to travel past the test position (against the urging of the spring 16) to the second position at which the retaining spring 66 becomes free to expand and to abut the shoulder 54 so as to prevent the movement of the first member 4 from the second position towards the first position.

It is thus possible to provide an inexpensive and effective lock that, in normal use, latches in the unlocked position, but in which latching can be inhibited so as to facilitate the testing of equipment locked by the lock.

I claim:

1. An actuator lock, comprising a first member movable between first, second and test positions, a latching member arranged to latch said first member at said second position when said first member reaches said second position, biasing means for biasing said first member towards said first position, and a test member movable between third and fourth positions, wherein said test member moves said first member from said first position to said test position when said test member moves from said third position to said fourth position and wherein said biasing means returns said first member from said test position to said first position.

2. A lock as claimed in claim 1, further comprising a housing having a supply passage formed therein, said housing defining a cylinder having an end wall; said cylinder, said end wall and said test member defining a variable volume chamber in fluid flow communication with said supply passage.

3. A lock as claimed in claim 2, in which said end wall has an aperture formed therein and in which said first member has a portion thereof extending in substantially fluid sealed engagement through said aperture in said end wall.

4. A lock as claimed in claim 2, in which said first member has an enlarged portion and in which said test member is movable in response to a fluid pressure within said variable volume chamber to abut said enlarged portion and thereby to urge said first member to move from said first position to said test position.

5. A lock as claimed in claim 4, in which said enlarged portion has a piston surface having a first surface area facing said variable volume chamber, said enlarged portion and said test member cooperating to form a piston having a surface area greater than the first surface area while said first member is between said first and test positions.

6. A lock as claimed in claim 4, in which said enlarged portion has a shoulder formed therein, and in which said latching member is arranged to engage said shoulder when said first member reaches said second position.

7. A lock as claimed in claim 4, in which said latching member extends from said housing into said cylinder.

8. A lock as claimed in claim 1, further comprising arresting means for preventing said test member from urging said first member to move from said test position to said second position.

9. A lock as claimed in claim 4, in which said enlarged portion is in substantially fluid sealed sliding engagement with said cylinder; said cylinder, said enlarged portion and said test member defining a further variable volume chamber and in which said test member and said first member are urged in response to a fluid pressure within said further variable volume chamber towards said third and second positions, respectively.

10. A lock as claimed in claim 9, in which one of said test member and said first member has a recess formed therein, and in which said latching member is carried on one of said test member and said first member and is arranged to permanently engage said recess when said first member is at said second position and said test member is at said third position.

11. A lock as claimed in claim 7, in which said latching member is a circlip held within a groove.

12. A lock as claimed in claim 10, in which said latching member is a circlip held within a groove.

13. A lock as claimed in claim 1, in which said biasing means is a spring.

14. An actuator lock, comprising a first member movable between first and second positions, a latching member, biasing means and a test member movable between third and fourth positions, said latching member being arranged to latch said first member at said second position when said first member reaches said second position, said biasing means being arranged to bias said first member towards said first position and said test member being arranged to permit operation of said latching member when said test member is at said third position and to inhibit operation of said latching member when said test member is at said fourth position.

* * * * *